United States Patent [19]

Holmes

[11] Patent Number: 4,912,898

[45] Date of Patent: Apr. 3, 1990

[54] GLASS BUTT JOINTS FOR CURTAIN WALL CONSTRUCTION

[76] Inventor: Thomas G. Holmes, 2732 N. West St., River Grove, Ill. 60171

[21] Appl. No.: 140,738

[22] Filed: Dec. 31, 1987

[51] Int. Cl.[4] ..... E04C 2/46

[52] U.S. Cl. ..... 52/235; 52/398; 52/790

[58] Field of Search ..... 52/235, 202, 203, 788, 52/790, 398, 399

[56] References Cited

U.S. PATENT DOCUMENTS

| | | | |
|---|---|---|---|
| 2,378,031 | 6/1945 | Paddock | 52/398 |
| 2,392,130 | 1/1946 | Downes | 52/202 |
| 2,604,061 | 7/1952 | Estey | 52/398 |
| 3,974,608 | 8/1976 | Grearson | 52/235 |
| 4,194,334 | 3/1980 | Katona | 52/399 |
| 4,253,286 | 3/1981 | Katona | 52/790 |
| 4,413,458 | 11/1983 | Ting | 52/235 |
| 4,552,790 | 11/1985 | Francis | 52/235 |

FOREIGN PATENT DOCUMENTS

| | | | |
|---|---|---|---|
| 611786 | 1/1961 | Canada | 52/235 |

*Primary Examiner*—David A. Scherbel
*Assistant Examiner*—Caroline D. Dennison
*Attorney, Agent, or Firm*—Cedric M. Richeson

[57] ABSTRACT

A glass butt joint for curtain wall construction is formed from a novel insulating glass panel unit having a peripheral edge with an outwardly opening U-shape and a novel pair of brackets adapted to hold a pair of adjacent panel units to a supporting framework member such as mullion or rail located within the interior of a building thereby providing an exterior glass surface which is mullion and/or rail free.

2 Claims, 3 Drawing Sheets

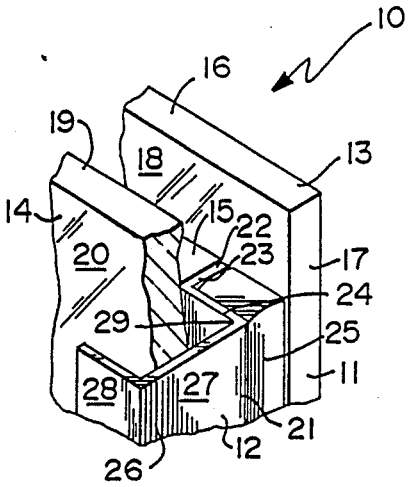
FIG.1
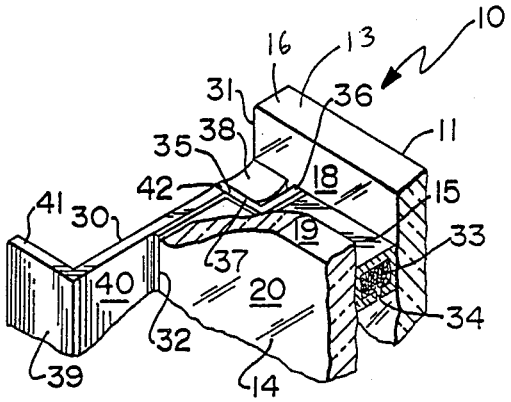
FIG.2
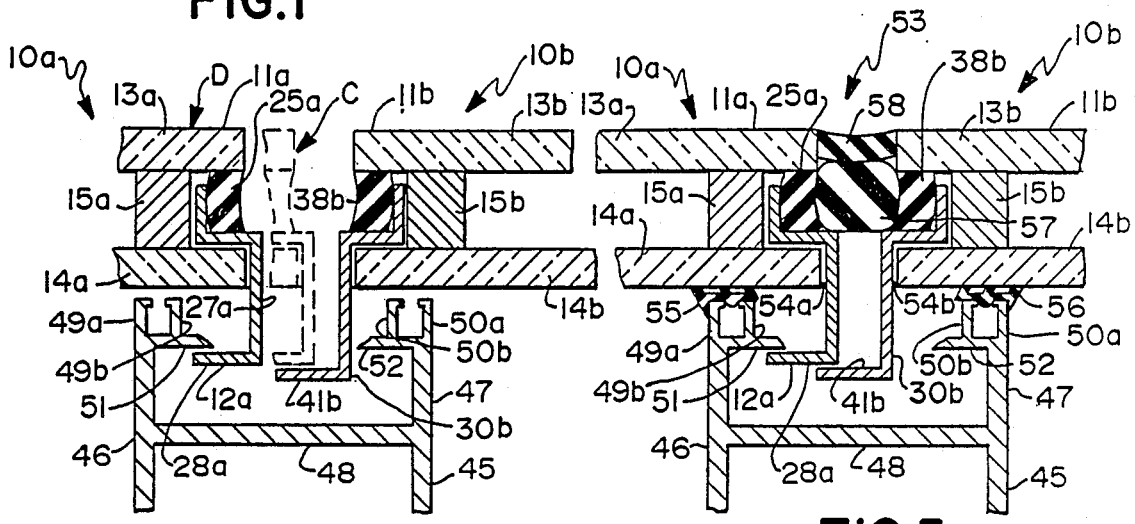
FIG.4
FIG.5
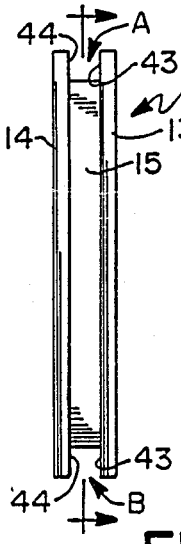
FIG.3
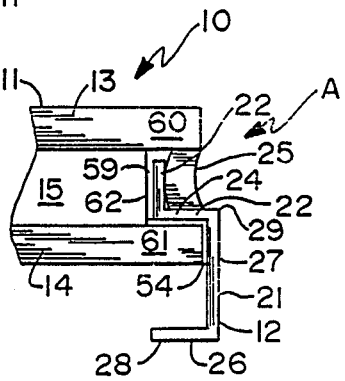
FIG.6
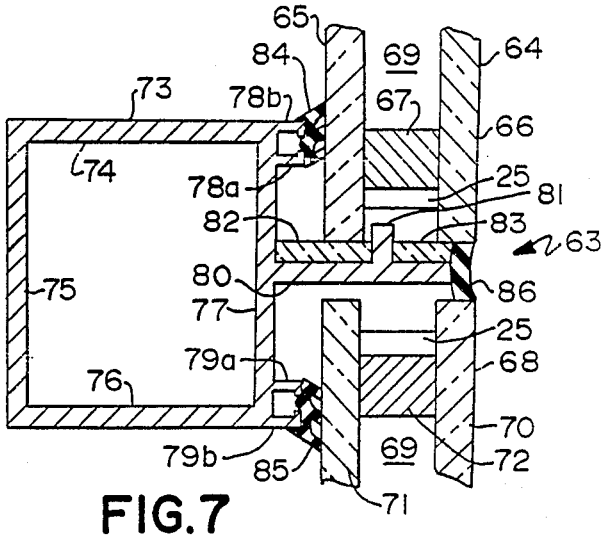
FIG.7

GLASS BUTT JOINTS FOR CURTAIN WALL CONSTRUCTION

BACKGROUND OF THE PRESENT INVENTION

The present invention relates to curtain wall and glass wall construction in general and glass panel joints and units in particular.

Curtain wall construction began to be widely employed by architects in the 1950s. Techniques and components of curtain wall construction have allowed architects to design and construct multi-story buildings having a building-supporting interior framework which obviates the necessity for massive exterior walls to support the building. Instead, in curtain wall construction, exterior walls need only support their own weight and serve chiefly to protect the building's interior from external environmental factors such as wind, rain, snow, etc. Curtain walls are non-bearing walls which are themselves supported by either direct or indirect attachment to a building's supporting framework. In a typical multi-storY curtain wall building, curtain walls are supported by attachment to floor structures which transmit loads to an interiorly disposed vertical framework. Advantages of curtain wall construction include faster enclosure of buildings during construction and the possibility of making extensive use of glass. A metal curtain wall may be defined as a non-load bearing wall supported by, or within, a metal framework. Many materials such as metal, glass, plastic, or masonry may be used for panels which are carried by, or within, the framework.

Curtain walls have been classified according to the method of installation employed. There are at least four generally recognized systems such as; (1) stick; (2) unit; (3) unit and mullion; and (4) panel.

In the stick method, construction proceeds piece by piece on site, generally beginning with attachment of vertical mullions to a building support such as a floor. Mullion attachment is followed by installation of horizontal rails and panels.

In the unit method, large factory assembled frame units (which may be preglazed) have frame edges adapted to interlock with adjoining units and the interlocked frames form mullions and rails.

In the unit and mullion method, mullions are initially installed and then factory assembled framed units are attached to the mullions.

In the panel method, formed sheet metal or cast panels interlock with adjoining Panels similar to the unit method. The main distinction between panel and unit is that each panel is generally formed as a whole single part e.g. by stamping.

Disadvantageously, none of the above systems provides an insulating glass unit curtain wall having a smooth outer surface which is mullion and/or rail free. An all glass outer curtain wall would provide a smooth outer surface without ridges or troughs thereby making maintenance, such as window washing, easier. A more esthetically pleasing exterior appearance would also be presented. By elimination of metal outer framework members, corresponding glazing would be eliminated. In addition, leakage due to thermal expansion cracks could be reduced by less need to employ materials of varying coefficients of thermal expansion. Also, leakage due to excessive wear of glazing compounds bY rain water funneled in troughs formed by raised outer framework members would be eliminated. A critical obstacle to creation of an outer framework-free, all insulating glass unit curtain wall has been the lack of a butt joint which has sufficient strength to provide a weather tight seal, allows for thermal expansion and contraction, and also securely holds the insulating glass panel units to an interior framework of the building. It would also be desirable that such joint allow for easY replacement of a broken or damaged insulating glass panel after completion of construction of the building and perhaps after years of use.

The aforementioned disadvantages have been reduced or overcome and beneficial aspects achieved by the present invention as described below.

SUMMARY OF THE INVENTION

According to the present invention, a novel butt joint is provided which is useful in curtain wall construction and utilizes novel insulating panel units (preferably insulating glass panel units) and novel brackets. The present invention provides an insulating glass panel unit having at least two parallel sheets of a material such as glass separated by at least one peripheral spacer, with the glass sheets and spacer held together by sealing means thereby forming an insulating unit which has at least one side with a peripheral edge of outwardly opening U-shape. The present invention also provides a novel bracket forming a member having means for securely attaching the member to a U-shaped side edge of an insulating panel unit and means for securely engaging an interior curtain wall framework member.

In forming a novel butt joint according to the present invention, a first insulating panel unit and second insulating panel unit are utilized with each of these units having both an outer and inner sheet of material (which is preferably glass) held together by sealing means in parallel alignment separated by a spacer thereby forming an insulating unit which has at least one side with a peripheral edge of outwardly opening U-shaPe.

The first unit has a first bracket attached to its U-shaPed edge by sealing means such as an adhesive sealant. This first bracket has a panel hook base and connected panel hook side substantially sealed within the U-shaped edge with the panel hook side extending out from the edge and forming an angle, preferably a right angle, with a connected framework hook side. This framework hook side extends distally from the first panel unit and extends at an angle, preferably a right angle, forming a framework hook base which extends parallel to the panel hook side thereby forming a U-shaped bracket portion. This bracket portion has the panel hook side and framework hook base forming sides of the U-shape with the framework side forming the base of the U-shape. The bracket framework hook base is adapted to engage or hook a curtain wall framework member such as a mullion or rail thereby securing the first panel unit to the curtain wall framework member.

The second panel unit is similar to the first panel unit. However, the second unit has a second bracket having, a panel hook base, panel hook side, framework hook side, and framework hook base connected together like the first bracket except that the framework hook base of the second bracket extends at an angle, preferably a right angle, from the second bracket's framework hook side outward from the second panel unit and engages the framework hook base of the first bracket thereby securing the second panel unit to the curtain wall framework member.

The butt joint is completed by sealing with glazing compound the outer sheet of the first unit to the outer sheet of the second unit thereby forming a butt joint having a substantially planar outer surface connecting the first and second units.

The present invention makes possible for the first time creation of a substantially all glass curtain wall wherein the outer wall forms a smooth glass surface interrupted only by glazing compound which seals adjacent glass panel units in novel butt joints. The novel insulated glass units of the present invention may be factory sealed to provide a very strong bond of the outer glass sheet to the inner glass sheet under carefully controlled conditions. The inner glass sheet may then by a combination of mechanical and sealing means be held securely to the interior framework of a building. By reducing or eliminating outside use of framework members such as mullions and/or rails, an esthetically pleasing, easy to maintain and a weathering resistant outer wall surface is created.

In a preferred embodiment of the present invention, rectangular insulated glass panel units may be factory sealed with a continuous outwardly opening U-shaped perimeter edge. These strong integral units may then be shipped to building sites for easy installation utilizing novel brackets of the present invention. These novel brackets may conveniently be formed in long lengths of extruded plastic or metal and cut to appropriate lengths on site. The brackets may be attached to the panel units by commerciallY available glazing compounds.

Advantageously, the inventive panel units and brackets may be attached or secured to presently used and commercially available interior framework members.

A further advantage of the present invention is that damaged panel units may be easily removed and replaced.

BRIEF DESCRIPTION OF THE DRAWINGS

FIG. 1 is a cut away isometric view of a corner of an insulating panel unit and bracket of the present invention.

FIG. 2 is a cut away isometric view of a corner of an insulating panel unit and bracket of the present invention adapted to engage the bracket of FIG. 1.

FIG. 3 is a side elevation view of an insulating panel unit.

FIG. 4 is a cross-sectional view of mating insulating glass panel units positioned adjacent a vertical mullion prior to final installation.

FIG. 5 is a cross-sectional view of an installed glass butt joint at an interior vertical mullion according to the present invention.

FIG. 6 is a cutaway top plan view of the unit and bracket assembly of FIG. 1.

FIG. 7 is a cross-sectional view of attachment of inventive insulating glass panels to an interior horizontal rail according to the present invention.

DETAILED DESCRIPTION OF THE INVENTION

Figure 8:
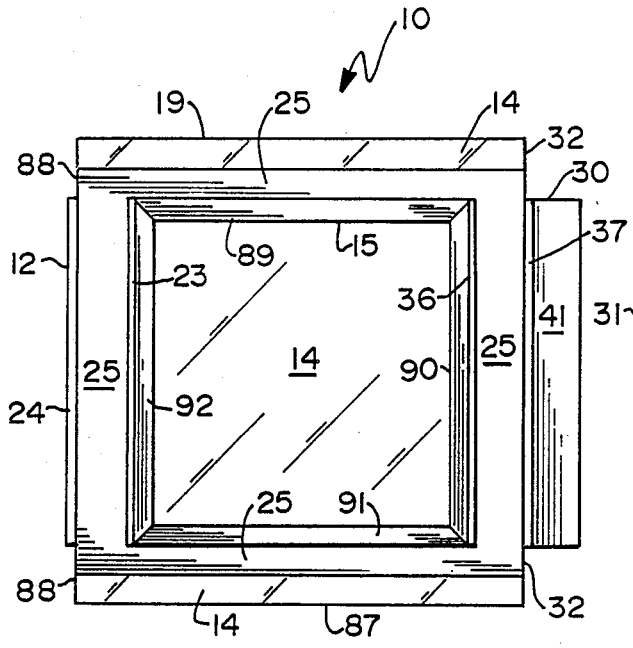
FIG. 8 is a front elevational view of an insulating glass panel unit and bracket assembly with its outer glass sheet removed.

Known butt glazed panels relying upon adhesion alone have insufficient strength for use in forming large paneled areas. The modified butt joint of the present invention which utilizes novel insulating panels and brackets combines adhesive strength with positive mechanical connections capable of holding large paneled areas securely in place with exterior butt joints. The present invention allows both vertical and horizontal butt glazing with elimination of vertical and horizontal exterior mullions and rails. Curtain walls of insulating glass panel units may be formed having exterior butt joints which are much stronger than prior art butt joints.

Referring now to FIG. 1, a cut away isometric view is presented of a corner of an insulating panel unit and bracket assembly 10. Assembly 10 comprises an insulating panel unit 11 with attached first bracket 12. The insulating panel unit 11 is formed from an outer sheet 13 and an inner sheet 14 which is aligned parallel to the outer sheet 13 and separated therefrom by a peripheral spacer 15. Sheets 13 and 14 may be made of any suitable building material such as metal, plastic or glass, etc. Preferably, sheets 13 and 14 are transparent and will beneficially comprise a glass of the type commonlY employed in presently available, well known, insulating glass units.

Clear, tinted, reflective, as well as opaque colored structural glasses are widely used in prior art panels and maY be advantageously employed with the present invention. Glass has many well known advantages as a panel material including day-lighting, solar heat gain in winter, low maintenance, fire resistance, etc.

Advantageously, insulating unit 11 has parallel rectangular glass sheets 13 and 14. Outer sheet 13 has a top edge 16, side edge 17 and inner surface 18. Inner glass sheet 14 has a top edge 19, and interior surface 20. Interior surface 20 of inner glass sheet 14 faces an interior space of a building such as a room. Inner sheet 14, outer sheet 13, and spacer 15 are all held together by sealing means to form an insulating panel unit 11.

Sealing means employed by the present invention include sealants commonly employed for such purposes in constructing prior art factory-sealed double glazing. Commonly used sealants include polysulfide, butyl, and silicone compounds. For further information concerning aPProPriate sealants, glasses, and curtain wall construction details see J. H. Callender, *Time-Saver Standards For Architectural Design Data,* 6th Ed. pp 90–124 and 147–152, McGraw-Hill Book Company (1982), which pages and material are hereby incorporated by reference into this document.

Referring again to FIG. 1, first bracket 12 is comprised of a member 21 which may extend in elongated fashion along the length of side edge 17. Elongated member 21 has means for secure attachment to a U-shaped side edge of an insulating panel unit 11 and also has means for securely engaging an interior curtain wall framework member. The panel unit attachment means may comprise panel hook means such as L-shaped hook 22 having a panel hook base 23 and connector panel hook side 24 forming the L-shape.

The panel hook base 23 lies adjacent to peripheral spacer 15 while the connector panel hook side 24 extends adjacent to an inner surface of inner sheet 14. Hook 22 is held in place within a U-shaped side edge of unit 11 by sealing means such as a silicone sealing compound 25. The outwardly opening U-shape is formed with inner surfaces of the opposing, parallel sheets 13, 14 comprising sides of the U-shape which are connected by spacer 15 which forms a base of the U-shape as best shown in FIG. 6. L-shaped parallel panel hook 22 is connected to framework engagement means including framework hook means such as L-shaped framework hook 26. Framework hook 26 has a framework hook side 27 connected to a framework hook base 28 to form an L-shape. Framework hook 26 and panel hook 22 are preferably integrally connected at a preferred right angle bend 29, which bend joins a top edge of panel hook side 24 to a top edge of framework hook side 27.

Referring now to FIG. 2, a cut away isometric view of an assembly 10 having an insulating panel unit 11 and a second bracket 30 of the present invention is depicted. The second bracket 30 is adapted to engage a bracket such as first bracket 12 depicted in FIG. 1. First bracket 12 and second bracket 30 will commonly be attached to opposing sides of insulating panel unit 11 so that a plurality of similar such units may be connected side by side or top to bottom as described below. Therefore, it should be apparent that the drawing of FIG. 2 may be correctly thought of either as a connecting portion of assembly adjacent to the similar assembly 10 shown in FIG. 1, or as a distal portion of the assembly itself depicted in FIG. 1.

Insulating panel unit 11 is formed of outer and inner parallel glass sheets 13, 14 seParated by peripheral spacer 15. Outer glass sheet 13 has a top edge 16, inner surface 18, and opposing side edge 31. Inner glass sheet 14 has an interior surface 20, top edge 19, and opposing side edge 32. Peripheral spacer 15 is recessed from top edges 16 and 19 to form the base of an outwardly opening U-shape with inner surface 18 of outer sheet 13 and an inner surface of inner sheet 14 forming the side of the U-shape. This novel recess provides means for mechanical attachment of unit 11 to an interiorly disposed framework with only an exterior butt joint. The spacer 15 may be formed of a bent sheet of metal, such as aluminum, thereby forming an interior space which may advantageouslY be filled with a desiccant 33 such as calcium chloride to adsorb moisture trapped between outer sheet 13 and inner sheet 14. A seam or series of perforations 34 provides access between trapped moisture and desiccant 33.

Second bracket 30 has an L-shaped panel hook 35 having a panel hook base 36 and panel hook side 37 forming an L-shape. Panel hook 35 is sealed to a side edge of panel unit 11 by sealing compound 38. Connected to panel hook 35 is L-shaped framework hook 39 having a framework hook side portion 40 and connected framework hook base 41 forming the L-shape. The framework hook side 40 is connected to the panel hook side 37 at right angle bend 42 to form a unitary bracket.

Comparison of first bracket 12 of FIG. 1 with second bracket 30 of FIG. 2 shows the brackets are similar in shape being mirror images of each other with the following exceptions. The framework hook base of first bracket 12 is aligned parallel to the panel hook side 24 of the first bracket 12, while the framework hook base 41 of the second bracket 30 extends awaY from the panel hook side 37 of the second bracket (in a plane parallel to a plane containing the panel hook side). Also, the framework hook side 40 of the second bracket is longer than the framework hook side 27 of the first bracket thereby forming the second framework hook base 41 to overlap the first framework hook base 28.

Referring now to FIG. 3, a side elevation view of an insulating panel unit 11 is shown having an outer glass sheet 13 and inner glass sheet 14 separated by a peripheral spacer 15 thereby closely forming an outwardly opening U-shaped edge as indicated by arrow A. It will be appreciated that the spacer 15 may be coated with or have a layer of sealant attached thereto as may portions of glass sheets 13, 14. Arrow B shows an opposing inverted U-shaped edge. The spacer 15 forms the base of the U-shape while distal edge portion 43 of outer sheet 13 and distal edge portion 44 of inner sheet 14 form sides of the U-shape. Spacer 15, and edge portions 43, 44 together form a recess adapted for receiving mechanical attachment means such as brackets 12, 30 (see FIGS. 1 and 2). Insulating glass panel unit 11 may advantageously be manufactured under carefully controlled conditions inside a factory much like factory sealed double glazing to produce a very strongly sealed insulating glass unit.

Factory assembly allows careful control of temperature, amounts, reaction and aging times, humidity, and elimination of contaminants, etc. to produce the strongest possible adhesive seals.

The fundamental difference between known factory sealed double glazing and the insulating glass unit of FIG. 3 is that the spacer and sealant or sealing means is recessed thereby producing a trough which enables mechanical attachment to an interior framework member with a exterior framework-free butt joint.

Advantageously, unit 11 may be mass produced under careful quality control and testing in factories and shipped for on site assembly to a building's interior framework. Brackets may be attached either at the factory or in the field. Factory attachment provides for greater quality control, while site assembly simplifies Packaging for shipping and reduces unit costs.

Referring now to FIG. 4, a cross-sectional view of mating insulating glass panel units **11*a* and 11*b* are shown positioned adjacent an interior framework member such as vertical mullion 45 prior to final installation. Advantageously, readily available stock framework members may be employed with the present invention. A commonly employed batten mullion framing member may be employed utilizing the inner cap which is designated here as vertical mullion 45 having opposing sides 46, 47 attached by connecting support 48. Each opposing side 46, 47 has a pair of opposing panel attachment extensions 49*a*, 49*b*, and 50*a*, 50*b*, respectively, which are adapted for receiving a glazing compound for attachment of unit inner sheets 14*a*, 14*b*, thereto, respectively. Opposing sides 46, 47 also have connected thereto respective projection tabs 51, 52. These tabs are used in the present invention to engage a framework hook base 28*a* of a first bracket 12*a***.

In constructing a curtain wall utilizing the present invention, supporting interior framework members such as vertical mullion 45 are assembled on site and connected in well known ways to a building's supporting structure (not shown). Then an inventive insulating panel unit **11*a* having an outer glass sheet 13*a*, inner glass sheet 14*a*, and spacer 15*a* is assembled with opposing brackets including a first bracket 12*a* sealed in an outwardly opening recess by sealant 25*a* to form an assembly 10*a*. Assembly 10*a* is positioned where indicated by phantom lines "C" with a framework hook base 28***a* of the first bracket 12*a* located within a cavitY formed bY projection tabs 51 and 52. Then the entire assembly 10*a* is repositioned sideways so that framework hook base 28*a* lies beneath projection tab 51 as indicated by solid lines "D." Once assembly 10*a* is properly positioned, it may be sealed in place as indicated below and in FIG. 5. After securing assembly 10*a* to mullion 45, an adjacent assembly 10*b*, formed of insulating glass panel unit 11*b* having outer glass sheet 13*b*, and inner glass sheet 14*b* separated by spacer 15*b* and having connected second bracket 30*b* sealed by sealant 38*b* within a peripheral recess of unit 11*b*, is positioned with a framework hook base 41*b* of second bracket 30*b* aligned within a cavity formed by projection tabs 51, 52, support 48 and mullion sides 46, 47 so that assembly 10*b* may be shifted and repositioned with the framework base 41*b* of the second bracket engaging the framework base 28*a* of the first bracket thereby securing the assembly 10*b* to the vertical mullion 45 as shown in FIG. 5 and described below. It should be clear from FIG. 4 that once assembly 10*a* is fixed in position D, sufficient room exists between a framework hook side 27*a* of the first bracket 12*a* and the projection tab 52 to allow the second bracket 30*b* to be positioned with its framework hook base 41*b* within the mullion cavity. While projection tab 52 is not necessary for this particular installation, it is a feature of many commercially available batten mullions and allows for flexibility in assembly since assembly 10*a*, 10*b* may also be installed in reverse position with a corresponding opposite sliding or repositioning motion.

Referring now to FIG. 5, a cross-sectional view of a butt joint 53 of the present invention is shown. The butt joint 53 is formed by positioning assembly 10*a*, 10*b*, and mullion 45 as described above with respect to FIG. 4 and then glazing with the appropriate sealants and components as described below.

Mullion 45 has opposing sides 46, 47 connected by support 48, with each side 46, 47 having respective attachment extensions 49*a*, 49*b*, 50*a*, 50*b* and projection tabs 51, 52 as described above for FIG. 4. Non-bearing walls such as curtain walls are supported directly or indirectlY by a structural framework (not shown) of a building. Mullion 45, for example, may be attached either directly to the structural framework or to projections from the structural framework, or to the floors attached to the structural framework, or to supplementary framing such as girts. Generally, mullion 45 and other framework members may be assembled utilizing known procedures for such construction methods as the stick system, or unit and mullion system.

Assembly 10*a*, advantageously, is a bracket 12*a* attached to a factory sealed insulating glass panel unit 11*a* formed from parallel, rectangular, glass sheets 13*a*, 14*a* held in spaced apart relationship by spacer 15*a*. All components are held securely together by a sealing compound (not shown). The factory sealed insulated glass panel unit 11*a* may be constructed with materials and according to methods known to those skilled in the art except that the peripheral spacer 15*a* and attendant sealing compounds are recessed in from the periphery of glass sheets 13*a*, 14*a* to provide an insulated glass panel unit 11*a* having a peripheral edge of outwardly opening U-shape. This U-shaped recess is adapted to accommodate means for securely engaging an interior wall framework member, such means comprising, for example, bracket 12*a*. Bracket 12*a* may be attached to insulated glass panel unit 11*a* either at the factory or in the field. Advantageously, factory installation provides for increased quality control since manufacturing processes and assembly may be performed under a controlled environment and optimum conditions of time, temperature, humidity, air quality, etc. Site installation may advantageously be employed for reduced shipping costs to the site and for increased flexibility in construction design and assembly. As noted above, bracket 12*a* may be made of any suitable structural material including engineering plastics and metals such as steel or aluminum or alloys thereof. Use of metal for bracket 12*a* is preferred for strength with a gasket 54*a* interposed between glass sheet 14*a* and bracket 12*a* to prevent metal/glass contact which may lead to scratching and/or weakening and damage to the glass and its integrity. Gasket 54*a* may be suitably made of a rubber type composition. Bracket 12*a* is secured within the outwardly opening U-shaped peripheral edge of insulating glass panel unit 11*a* by sealant 25*a*.

In forming butt joint 53, assembly 10*a* is first properly positioned relative to mullion 45 with a framework hook base portion 28*a* of bracket 12*a* extending behind and adjacent to mullion projection tab 51. Then assembly 10*a* is glazed to mullion 45 by applying glazing compounds or sealant 55 to adhesively connect mullion attachment extensions 49*a*, 49*b* to inner glass sheet 14*a*. Thus, assembly 10*a* is both mechanically and adhesively secured to mullion 45. It is mechanically and adhesively attached by hooking the bracket 12*a* (through framework hook base 28*a*) to mullion projection tab 51 with inner glass sheet 14*a* adhesively a butting and joining mullion attachment extensions 49*a*, and 49*b* through sealant 55. Beneficially, sealant 55 will allow for some movement of assembly 10*a* relative to mullion 45 to accommodate environmental changes such as thermal expansion and contraction, pressure differentials due to factors such as external winds and internal ventilation systems, etc. Protection tab 51 and bracket framework hook base 28*a* secures assembly 10*a* from excessive outward movement relative to mullion 45 while inner glass sheet 14*a* and mullion attachment extensions 49*a*, 49*b* restricts excessive inward movement.

Following attachment of assembly 10*a* to mullion 45, assembly 10*b* is repositioned as described above in FIG. 4. Generally, assembly 10*b* comprises a unit identical to assembly 10*a*. Assembly 10*b* advantageously has a factory sealed insulating glass unit 11*b* formed from parallel, rectangular, outer glass sheet 13*b* and inner glass sheet 14*b* separated by peripheral spacer 15*b* and all held together by sealing means as described above for assembly 10*a*. Similar to the attachment means used to connect bracket 12*a* to assembly 10*a*, bracket 30*b* is attached to unit 11*b* by sealant 38*b* with gasket 54*b* interposed between bracket 30*b* and inner glass sheet 14*b*. Bracket 30*b* differs from bracket 12*a* in the bracket 30*b* has a framework hook base 41*b* which is adapted to hook behind the framework hook base 28*a* of bracket 12*b*. Brackets 12*a* and 30*b* are substantially as described above with respect to respective brackets 12 and 30 shown in FIGS. 1 and 2. It should be clearly understood that in a preferred embodiment of the invention, each rectangular assembly will have one side equipped with a bracket 12 and an opposing side equipped with a bracket 30. Therefore, a plurality of assemblies 10 may be installed in side by side fashion with, for example, a bracket 12*a*, engaging a mullion 45 and a bracket 30*b* engaging a bracket 12*a* (and therefore indirectly engaging mullion 45) at each butt joint 53. Once assembly 10*b* is appropriately positioned, as described above, the mullion attachment extensions are glazed to the inner glass sheet 14*b* of assembly 10*b* by glazing compound or sealant 56 as described above for glazing of assembly 10*a* to the mullion 45.

Installation of the butt joint is now completed by insertion of optional filler 57 and exterior sealant 58. Optional filler 57 may comprise rope caulking such as a polyurethane composition or a neoprene gasket or other resilient materials. Filler 57 acts to cushion adjoining insulating glass units while allowing expansion and contraction. Application of the exterior sealant 58 produces a glazed exterior butt joint of superior appearance and strength. Sealant 58 may beneficially comprise a silicone gun or rope caulking and may advantageously employ a reflective glazing compound to produce a continuous, smooth, reflective surface with appropriate exterior glass sheets.

Suitable sealants, fillers, caulking, gaskets and glazing compounds which may be usefully employed with the present invention include silicone compounds, butyl rubber, polyisobutylene, polysulfide rubber, neoprene, polyurethane, vinyl chloride and copolymers, polybutene, etc. These compositions may include reinforcing materials such as fiberglass. Also, these materials may be applied by gun or knife, or as a preformed gasket or rope, or by any means known in the art.

Referring now to FIG. 6, a cut away top view is depicted of assembly 10 of FIG. 1. Assembly 10 comprises a first bracket 12 attached to an insulated glass panel unit 11 by sealing means such as silicone sealant 25. The insulated glass panel unit 11*a*, has an outer glass sheet 13 connected by sealant (not shown) to an inner glass sheet 14, in spaced apart, parallel alignment with an interposed peripheral spacer 15. The bracket 12 may suitably be a elongate member 21 having an L-shaped panel hook 22 connected to an L-shaped framework hook 26 at right angle bend 29. Panel hook Portion 22 of bracket 12 has a panel hook base 23 connected at a right angle to panel hook side 24. Framework hook portion 26 of bracket 12 has a framework hook base 28 connected at a right angle to framework hook side 27. The framework hook 26 is connected to the panel hook 22 a right angle bend 29. The bracket 12 may be made of extruded aluminum cut to appropriate length or of sheet metal bent to form the indicated shape. A protective gasket 54, (made, for example, of rubber) is interposed between glass sheet 14 and bracket 12. Generally, care will be taken to avoid direct glass/metal contact where possible to avoid damage to the glass. The bracket 12 may have openings or perforations through the panel hook side 24 and/or panel hook base 23 to insure a strong adhesive seal among the glass sheets, bracket and/or spacer. Also, an air gap may advantageously be provided between the bracket 12 and sealed space 15 to accommodate thermal expansion and contraction. In an alternative embodiment, the spacer 15 and bracket 12 may be formed as a unitary Piece or strongly bonded together, for example, by welding, riveting, soldering, chemical bonding, etc. As is clearly shown in FIG. 6, the end Portion 60, 61 of sheets 13, 14, resPectively, form the side of an outwardly opening U-shaped channel or edge "A" with peripheral spacer edge 62 connecting sides 60 and 61 as a base of the U-shape. Located at a position opposing and distal to edge "A," there will suitably be another outwardly opening U-shaped front edge as best seen in FIG. 3. This edge will contain a second bracket which is the mirror image of the connection shown in FIG. 6 except that a framework base portion of the second bracket will extend about 180 degrees from the expected mirror image position and a framework side portion of the second bracket will extend at a distance which is at least the thickness of the framework base portion in addition to the distance between the panel hook side and framework hook base of the first bracket.

Referring now to FIG. 7, a cross-sectional view is presented of a butt joint. In constructing a typical curtain wall according to the instant invention, butt joints will be formed along internal vertical mullions as described above with respect to FIG. 5, and butt joints will be formed along horizontal rails as described below. A horizontal rail connected butt joint 63 is formed between adjacent upper insulating glass panel unit 64 having inner glass sheet 65 and outer glass sheet 66 connected in spaced apart, parallel relationship by spacer 67 and a similar lower unit 68 utilizing a suitable, preferably factory applied, sealant 25. Insulating panel units such as unit 64 and 68 preferably have a void or air space 69 between the inner sheet and outer sheet to provide thermal insulation. Lower insulating glass panel unit 68 has an outer glass sheet 70 connected to inner glass sheet 71 separated by space 72.

A horizontal interior framework member of a building such as an elongate rail 73 is connected either directly or indirectlY to a structural supporting framework of a building. Mullions such as mullion 45 of FIG. 5 maY be combined with rails such as rail 73 to provide an interior framework for attachment of insulating panel units (see FIG. 13).

Horizontal rail 73 has an upper member 74 connected to rear member 75 which is in turn connected to lower member 76 which in turn is connected to front member 77 which in turn is connected to the upper member 74 to for an elongate horizontal support. Advantageously members 74, 75, 76, and 77 are integrally connected at right angles forming a rectangular cross-section with upper member 74 parallel to lower member 76 and rear member 75 parallel to front member 77. Upper attachment extensions 78*a*, 78*b* project outward from front member 77 adjacent upper member 74. While lower attachment extensions 79*a*, 79*b* project outward from front member 77 adjacent lower member 76. A projecting rail support 80 is centrally attached to the front member 77 and extends perpendicular and outward there from. Integral with support 80 is an upwardly projecting catch arm 81.

Resilient pads 82 and 83 provide a cushioned surface upon which the upper insulating glass panel unit 64 rests with outer glass sheet 66 and inner glass sheet 65 resting upon pads 83 and 82 respectively. The pads 82 and 83 may be made of any protective material such as rubber, plastic or cellulosic compositions, etc. Thus, the weight of upper unit 64 is transferer via pads 82, 83 bY rail 73 to a supporting framework of the building.

Catch arm 81 extends upward into an outwardlY opening U-shaped lower edge of upper unit 64 to provide a mechanical connection which prevents upper unit 64 from an excessive outward movement. Catch arm 81 may advantageouslY be covered with a protective pad or coating to prevent direct contact between glass sheet 65 and arm 81, since the catch arm 81 and entire rail 73 is Preferably made of a metal or metal alloy such as aluminum.

After positioning of uPPer unit 64 on rail suPPort 80, inner glass sheet 65 is glazed to rail 73 by applying a resilient adhesive sealant 84 to connect inner glass sheet 65 to upper attachment extensions 78*a*, 78*b* of rail 73. Adjacent lower insulating glass panel unit 68 is also glazed to rail 73 by applying a resilient adhesive sealant 85 to connect inner glass sheet 71 to lower attachment extensions 79*a*, 79*b* of rail 73. Appropriate compositions for use as sealants 84 and 85 are well known in the art. Advantageously, resilient sealants will be employed to accommodate movement of units 64 and 68 relative to rail 73 due, for example, to pressure differentials and thermal contraction and expansion.

The horizontal butt joint is completed by glazing upper unit 64, rail support 80 and lower unit 68 together with glazing compound 86 to form a smooth outer surface across the exterior of outer sheets 66, 70 and sealant 86. It will be appreciated by one of ordinary skill that either of units 64 and 68 may be installed first with the adjacent unit later installed to complete joint 63. Furthermore, it should be appreciated that formation of a wall such as a curtain wall which utilizes the above described horizontal rail butt joints in conjunction with the above described (See e.g. FIG. 3) vertical mullion butt joints will produce a novel insulated glass panel unit with internal mechanical or non-adhesive hooking means connecting a rectangular unit to an interior framework on three of four sides of the rectangle. The use of mechanical hooking means for attachment of the unit to an interior supportive framework in addition to the use of adhesive sealant greatly improves the strength and integrity of the wall.

Advantageously, the present invention allows construction of curtain walls having exterior surfaces with all sides of the insulating glass panel units free of exterior mullions, rails, or framework members. A smooth outer surface may be constructed which is virtually all glass except for a relatively narrow strip of glazing compound compared to prior art surfaces having external face members.

While the present invention is not limited to use of glass as material forming the outer and inner sheets of the insulating panel unit, the present invention is particularly useful in that it provides for the first time means and structure for producing a vast virtually all glass exterior wall surface with continuous, outer framework-free butt joints surrounding individual insulating glass panel units.

A further advantage of the present invention is that sloped glass surfaces may be constructed without utilizing secure butt joints, thereby avoiding surface barriers which form troughs and channels which subject the joints to leaks due to weathering.

It will be recognized by skilled artisans that the above described inventive butt joints may accommodate expected movement of relative members of the joints and also provide adequate environmental sealing to minimize thermal transfer across the joint.

Referring now to FIG. 8, a front elevational view is presented of an embodiment of the inventive assembly 10 with its outer glass sheet removed for clarity. An inner glass sheet 14 is shown having a top edge 19 and parallel bottom edge 87 connected bY opposing parallel side edges 32, 88 to define a rectangular glass sheet 14. A peripheral space 15 having connected segments 89, 90, 91, 92 forming a rectangular shape is sealed in place by sealant 25. Sealant 25 also seals in place the first bracket 12 and second bracket 30. First bracket 12 has a panel hook base 23 connected to a panel hook side 24 which in turn is connected to a framework hook side (see e.g. FIG. 1). Second bracket 30 has a panel hook base 36 connected to a panel hook side 37 which is connected to a framework hook base 41 via a framework hook side (see e.g. FIG. 2).

Figure 9:
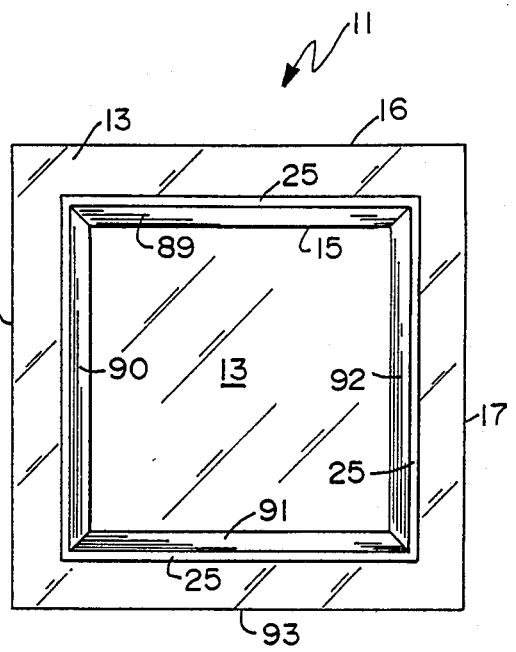
FIG. 9 is a sectional view of an insulating glass panel unit taken along lines 9—9 of FIG. 3.

Referring now to FIG. 9, a sectional view is presented of insulating glass panel unit 11 taken along lines 9—9 of FIG. 3. Insulating glass panel unit 11 has an outer glass sheet 13 having a toP edge 16 and parallel bottom edge 93 connected by parallel opposing side edges 17 and 31. A Peripheral spacer 15 having segments 89, 90, 91, and 92 is sealed in place by sealant 25. Unit 11 may advantageously be factory sealed with a inner sheet and have hook means installed on site.

In a preferred embodiment of the invention sealant 25 will be applied around the periphery of spacer 15 to an outer glass sheet 13, spacer 15, and corresponding inner glass sheet together to form a unitary whole unit 11. This sealant may be factory applied to achieve an optimum seal. Subsequently, bracket (see e.g. FIG. 8) may be advantageously applied with panel hook base portions adjacent to the sealant coated spacer to provide the strongest possible assembly. For clarity of illustration, the sealant 25 which is applied to the spacer 15 is omitted from view in most other figures, but it should be clearly understood that application of such sealant is preferred to provide the strongest possible adhesive seal.

Figure 10:
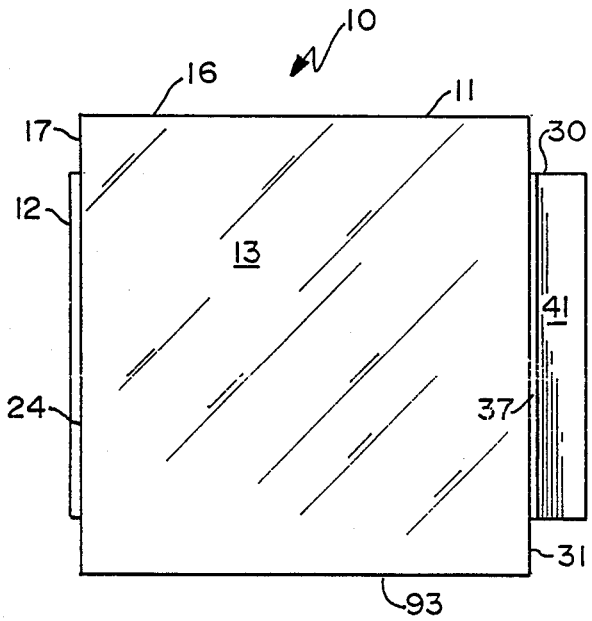
FIG. 10 is a front elevation of an insulating glass panel unit and bracket assembly.

Referring now to FIG. 10, a front elevation is shown of an assembly 10 such as the one shown in FIGS. 1 and 2. Assembly 10 is formed of an insulating glass panel unit 11 and connected first bracket 12 and second bracket 30. Unit 11 has an outer glass sheet 13 with top edge 16, bottom edge 93 and side edges 17 and 31. First bracket 12 shows a portion of a panel side edge 24, while second bracket 30 shows a framework hook base 41 and portion of a Panel hook side edge 37 which is connected to hook base 41 via a framework hook side (See e.g. FIG. 2.).

Figure 11:
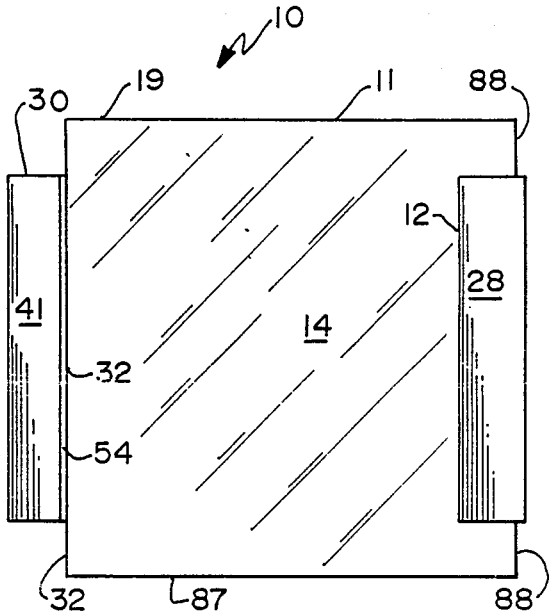
FIG. 11 is a rear elevation of the assembly of FIG. 10.

Referring now to FIG. 11, a rear elevation is shown of assembly 10 of FIG. 10. Assembly 10 comprises (a) an insulating glass panel unit 11 having an inner glass sheet 14 with top edge 19, bottom edge 87, and side edges 32 and 88, and (b) first and second brackets 12 and 30. First bracket 12 is elongate in shape and has a framework hook base 28. Second bracket 30 is also elongate in shape and has a framework hook base 41. The second bracket 30 has a gasket 54 protecting the inner glass sheet 14 from direct contact with the second bracket 30.

Figure 12:
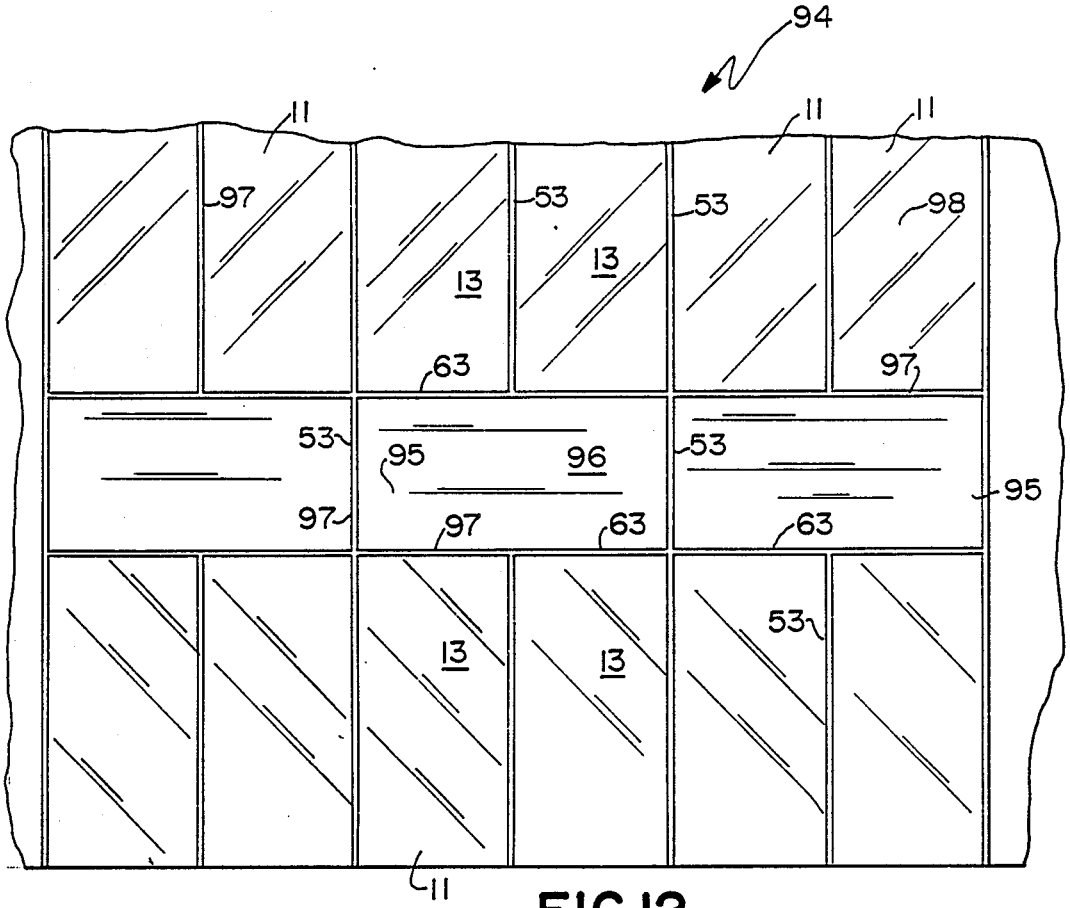
FIG. 12 is a cut away front elevational view of an exterior insulating glass panel curtain wall of the present invention.

Referring now to FIG. 12, a front elevation of a glass curtain wall 94 is depicted according to the present invention. In both FIGS. 12 and 13, glazing thickness is not to scale, but instead exaggerated for claritY. In all figures, sealant thickness may be exaggerated for clarity of illustration. A plurality of insulating glass panel units 11 and 95 are shown connected bY inventive vertical and horizontal butt joints 53, 63. Units 11 and 95 are similar with each unit 11 having a transparent outer sheet 13, while each unit 95 uses an opaque outer glass or plastic sheet 96 for esthetic reasons. Both butt joints 53, 63 are sealed with readily available exterior sealants such as silicone caulking or glazing compound 97. Of course, many types of glasses and materials may be used with the present invention. The curtain wall 94 of FIG. 12 presents a smooth outer framework-free surface which has no mullions or rails to funnel rain water and thereby cause deleterious wear to the joints. Also the smooth, substantially planar surface 98 which extends across butt joints 53 and 63 makes exterior surface 98 easier to clean and maintain.

Figure 13:
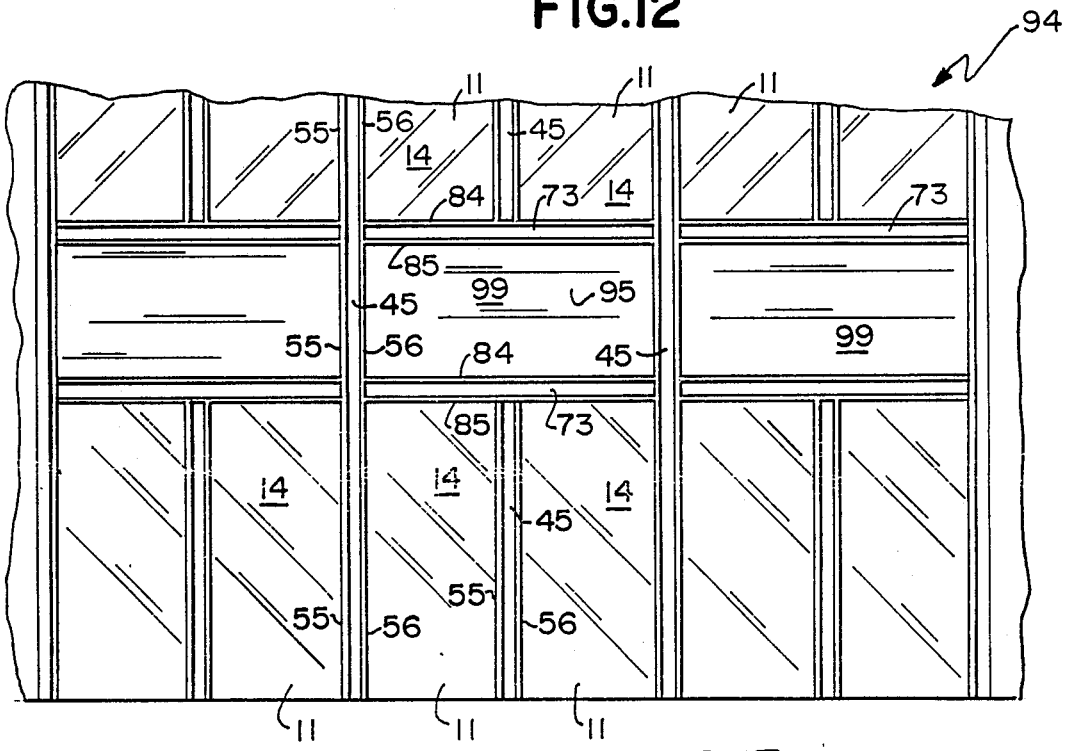
FIG. 13 is a cut away rear elevational view of the curtain wall of FIG. 12.

Referring now to FIG. 13, a rear elevation is presented of the curtain wall 94 of FIG. 12. Insulating panel units 11 and 95 are supported by interior framework members such as a plurality of vertical mullions 45 and a plurality of horizontal rails 73. Panel units 11 and 95 have respective inner sheets 14 and 99. Each inner sheet 14 and 99 is glazed to adjacent mullions 45 with sealants 55, 56 (as also shown in FIG. 5). Each inner sheet 14 and 99 is also glazed to adjacent rails 73 with sealant 84, 85. The interior appearance of the curtain wall 94 is similar to known walls. However, as described above, the exterior, appearance is dramatically different, especially in close proximity to the exterior wall. Also, the added strength provided by the present system of butt joint construction is unknown in prior butt joint systems.

Further modification of the butt joints, insulating panel units, brackets, assemblies, construction techniques and apparatus described herein will be apparent to those of ordinary skill in the art and all such modifications and changes are deemed to be within the scope of the present invention, particularly as defined by the following claims.

What is claimed is:

1. An insulating panel unit comprising:

(a) at least two parallel glass sheets separated by at least one peripheral spacer, said sheets and spacer held together by sealing means thereby forming an insulating unit, said unit having at least two opposing sides with each of said sides having a peripheral edge of outwardly opening U-shape; and (b) hook means attached within each of said opening U-shaped peripheral sides, each of said hook means comprising a panel attachment member sealed within said U-shaped peripheral edge and an extension member connecting said panel attachment member to a framework hook member, wherein each of said framework hook members extends in parallel spaced-apart relationship to the plane of said sheets of glass, and said hook members are located distal from said sheet of glass with each hook member extending from its respectively connected extension member in the same direction as the hook member connected to said opposing U-shaped peripheral side of said panel.

2. A glass butt joint comprising:

a first insulating glass panel unit and a second insulating glass panel unit; each of said units having an outer sheet of glass and a parallelly aligned inner sheet of glass separated by a spacer, said glass sheets and spacer held together by sealing means thereby forming an insulating unit which has at least one side with a peripheral edge of outwardly opening U-shape;

said U-shaped edge of said first unit having attached thereto by an adhesive sealant a first bracket having a panel hook base and connected panel hook side substantially sealed within said U-shaped edge, said panel hook side extending out from said edge and forming a right angle with a connected framework hook side which framework hook side extends distally from said first Panel unit and forms a right angle with a connected framework hook base which extends parallel to said panel hook side therebY forming a U-shape bracket portion, with said panel hook side and framework hook base forming sides of said U-shaped bracket portion and said framework side forming a base of the U-shaped bracket portion, said bracket framework hook base engaging a curtain wall framework member thereby securing said first panel unit to said curtain wall framework member; and having said U-shaped edge of said second unit aligned adjacent to and facing said U-shaped edge of said first unit with said second unit having attached thereto by an adhesive sealant a second bracket having a panel hook base and connected panel hook side substantially sealed within said U-shaped edge of said second unit, with said panel hook side extending out from said edge and forming a right angle with a connected framework hook side which framework hook side extends distally from said second panel unit and forms a second right angle with a connected framework hook base which base extends outward engaging said framework hook base of said first bracket thereby securing said second panel unit to said curtain wall framework member; and said butt joint further comprising glazing compound connecting an edge of said outer glass sheet of said first unit to an adjacent edge of said outer glass sheet of said second unit thereby forming glass butt joint having a substantially planar outer surface connecting said first and second units.

* * * * *